US006656418B2

(12) United States Patent
Montagnon et al.

(10) Patent No.: US 6,656,418 B2
(45) Date of Patent: Dec. 2, 2003

(54) STEEL COMPOSITION, METHOD FOR MAKING SAME AND PARTS PRODUCED FROM SAID COMPOSITIONS, PARTICULARLY VALVES

(75) Inventors: Jacques Montagnon, Clermont-Ferrand (FR); Frédéric Perdriset, Saint-Georges de Mons (FR)

(73) Assignee: Societe Industrielle de Metallurgie Avancee (S.I.M.A.), Paris (FR)

( * ) Notice: Subject to any disclaimer, the term of this patent is extended or adjusted under 35 U.S.C. 154(b) by 0 days.

(21) Appl. No.: 10/030,860

(22) PCT Filed: May 7, 2001

(86) PCT No.: PCT/FR01/01388

§ 371 (c)(1),
(2), (4) Date: May 9, 2002

(87) PCT Pub. No.: WO01/86009

PCT Pub. Date: Nov. 15, 2001

(65) Prior Publication Data

US 2003/0044304 A1 Mar. 6, 2003

(51) Int. Cl.[7] ..... C22C 38/48; C21D 8/00

(52) U.S. Cl. ..... 420/48; 420/584.1; 148/649; 148/327; 148/442

(58) Field of Search ..... 420/48, 584.1; 148/649, 327, 442

(56) References Cited

U.S. PATENT DOCUMENTS

| | | | |
|---|---|---|---|
| 3,826,689 | A | 7/1974 | Sandao et al. |
| 6,033,626 | A | 3/2000 | Takahashi |

FOREIGN PATENT DOCUMENTS

| | | |
|---|---|---|
| EP | 0467756 A1 | 10/1991 |
| EP | 0526174 A1 | 7/1992 |
| JP | 03177543 | 8/1991 |
| JP | 11236653 | 8/1999 |

*Primary Examiner*—Deborah Yee
(74) *Attorney, Agent, or Firm*—Webb Ziesenheim Logsdon Orkin & Hanson, P.C.

(57) ABSTRACT

This invention relates to a steel composition comprising, expressed in percentages by weight: 0.25–0.35% C, 24–28% Cr, 10–15% Ni, 3–6% Mn, 1.75–2.50% Nb, 0.50–0.70% N, 0–0.30% Si, provided that C+N≧0.8%, the rest consisting mainly of iron and unavoidable impurities. The invention further relates to a method for making said compositions and valves produced from said compositions or using said method and exhibiting excellent mechanical strength and oxidation resistance at temperatures between 800 and 900° C.

18 Claims, 4 Drawing Sheets

STEEL COMPOSITION, METHOD FOR MAKING SAME AND PARTS PRODUCED FROM SAID COMPOSITIONS, PARTICULARLY VALVES

BACKGROUND OF THE INVENTION

1. Field of the Invention

This invention relates to steel compositions intended in particular for the manufacture of intake and exhaust valves for vehicles that are powered by an internal combustion engine.

2. Description of Related Art

During use, this type of part is subjected to major mechanical stresses at temperatures that continue to rise as the power and performance of the engines in which they are installed increases. Currently, when the engine intake includes a turbo, this temperature is generally between 200 and 400° C., although it can reach 800° C. at the level of the exhaust when the fuel used is gasoline. The exhaust valves can therefore be subjected to temperatures that range up to 900° C. for each ignition followed by an exhaust. The materials used for these valves must also be able to withstand sudden and large variations in temperature.

This increase in the temperatures of the valves during operation makes them even more sensitive to oxidation and corrosion caused by certain components of the fuels used, such as lead, sulfur and vanadium pentoxide, which reduce the useful life of the valves.

The direct oxidation of the metal represents the primary mechanism in the European countries, where regulations tend to require the use of unleaded gasoline and a reduction in the amount of sulfur in fuels to very low levels, on account of atmospheric pollution.

Apart from these various stresses that are encountered during the utilization of the finished parts, the steel or alloy used to manufacture them must also satisfy certain additional criteria. The valves are generally manufactured in two stages. First of all, the steelmaker will prepare a grade of steel or alloy which it will then supply to the valve manufacturer in the form of bars that have been straightened, but which may also have been rough turned or subjected to any other surface treatment specified by the customer. This manufacturer will then proceed to shear these bars, in an operation that is also called blank cutting. In an initial manufacturing process, the bar is cut into blanks at a high temperature, which is followed by the extrusion of the blanks into valves at temperatures ranging from 1150 to 1200° C., which requires that the grain structure of the bar supplied remain stable up to the forging temperatures.

In a second manufacturing process, called upsetting, the blanks are obtained by shearing at the ambient temperature, which requires a metal that is not very brittle, to prevent non-uniform shearing and the cracking of these blanks. It has also been found that during this cold shearing operation, problems can occur that are related to carbide segregations in the blanks, which can result among other things in excessive wear of the tools.

The steels of the prior art cause problems during shearing because, among other things, the appearance of cracks in the parts requires frequent adjustments to the production lines.

The materials conventionally used for the manufacture of valves of this type include austenitic stainless steels, which have an iron-nickel-chromium base and range from steels with a high manganese content (up to 10% by weight) to steels with a high nickel content (up to 21% by weight). The high-temperature oxidation resistance of these steels is not always satisfactory, in particular when, for example, the engine is operating in a marine atmosphere and is exposed to chlorine, or when an increase in the performance of the engine results in hotter combustion gases. These insufficiencies have led steelmakers to increase the chromium content of their steels even further, which has the disadvantage that it promotes the formation of ferrite at high temperature, as well as intermetallic phases that make the steel brittle at engine operating temperatures.

SUMMARY OF THE INVENTION

The essential object of this invention is therefore to eliminate the above mentioned disadvantages of the steel compositions of the prior art by making available steel compositions that have, among other things, improved resistance to oxidation, improved mechanical characteristics and improved operational properties that make it possible, among other things, to manufacture exhaust valves that have excellent mechanical strength and resistance to oxidation in the temperature range from 800 to 900° C.

For this purpose, a first object of the invention consists of a steel composition which contains, expressed in percentages by weight:

| | |
|---|---|
| C | 0.25–0.35% |
| Cr | 24–28% |
| Ni | 10–15% |
| Mn | 3–6% |
| Nb | 1.75–2.50% |
| N | 0.50–0.70% |
| Si | 0–0.30% |

whereby C+N≧0.8%,
and the rest consists primarily of iron and the unavoidable impurities.

In one preferred embodiment of the invention, the steel composition includes, expressed in percentages by weight:

| | |
|---|---|
| C | 0.25–0.32% |
| Cr | 25–26% |
| Ni | 11.50–12.50% |
| Mn | 4.80–5.20% |
| Nb | 1.90–2.30% |
| N | 0.61–0.70% |
| Si | 0–0.30% |

whereby C+N≧0.9%,
and the rest consists primarily of iron and the unavoidable impurities.

The inventors have discovered, to their surprise, that the steel compositions defined above all have a solidification mode that is very close to a eutectic between the y phase of austenite and a phase which has been found to he a niobium carbonitride Nb(C,N).

BRIEF DESCRIPTION OF THE DRAWINGS

Three phases diagrams are presented in FIGS. 1 to 3, which correspond respectively to.

DETAILED DESCRIPTION OF THE PREFERRED EMBODIMENTS

Figure 1:
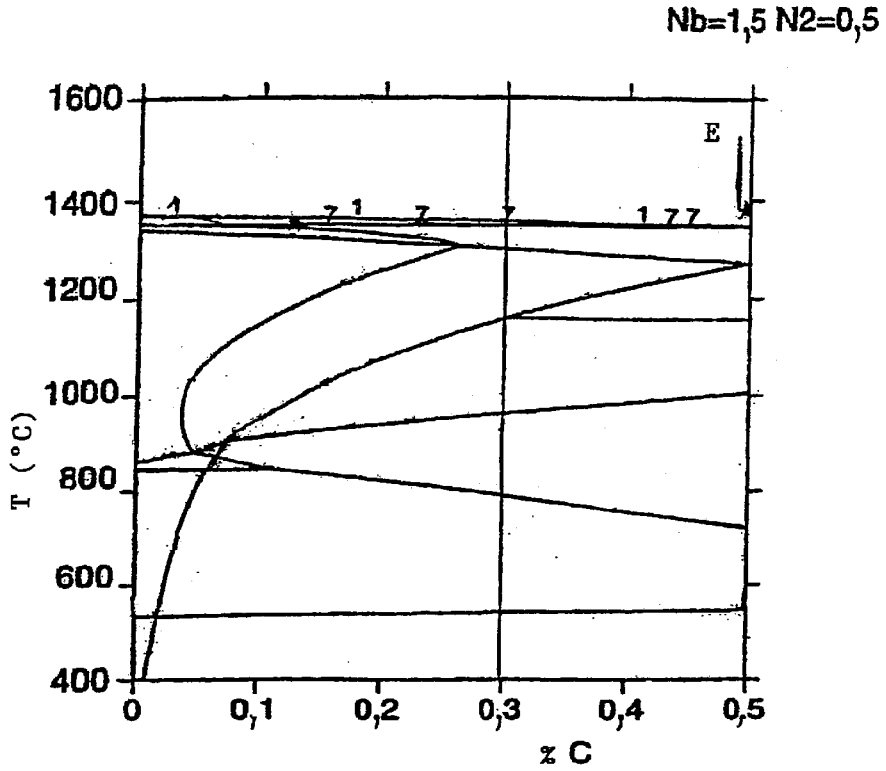
In FIG. 1: Steel compositions not as taught by this invention and containing 0.286% C, 4.93% Mn, 11.92% Ni, 25.21% Cr, 0.292% Si, but 1.5% niobium and 0.5% nitrogen, In FIG. 2: Steel compositions as taught by this invention and identical to those described above, but containing 1.75% niobium and 0.525% nitrogen, In FIG. 3: Steel compositions as taught by this invention and identical to those described above, but containing 2% niobium and 0.55% nitrogen.
Figure 2:
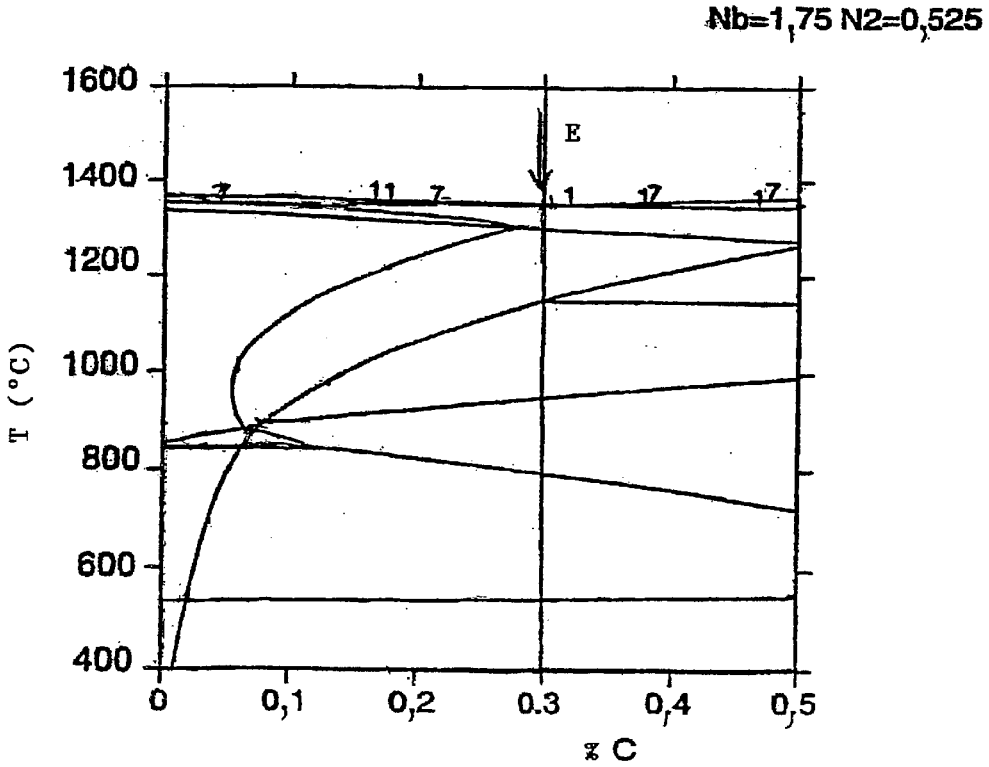
Figure 3:
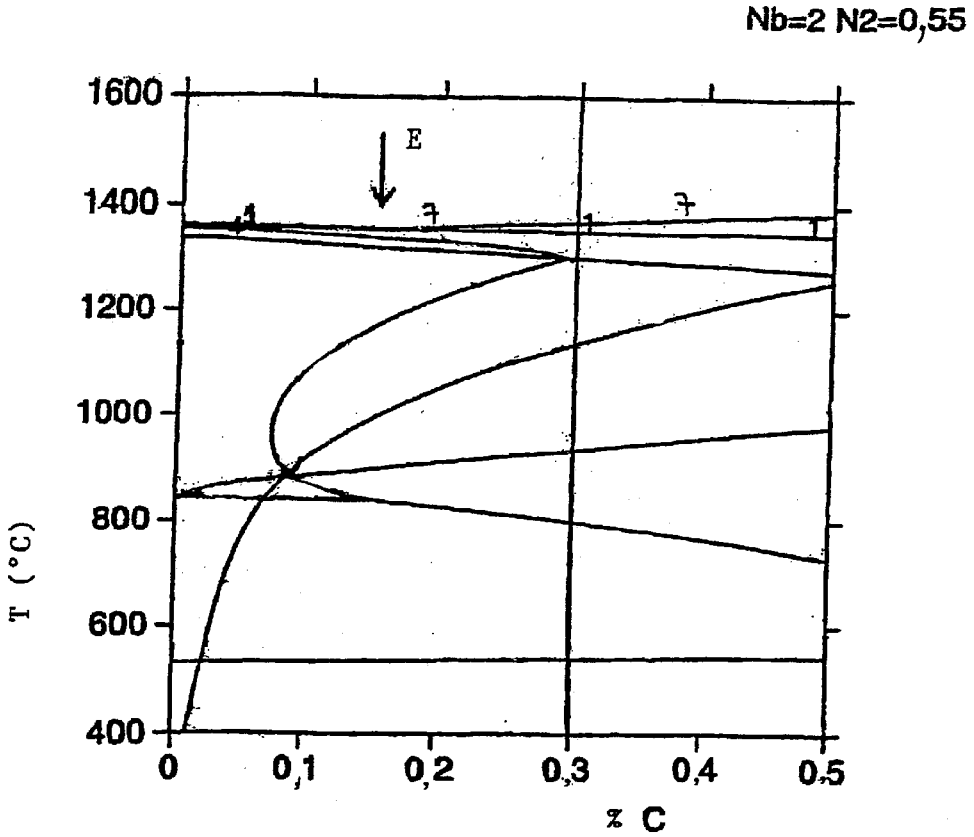

The phase diagrams in FIGS. 1–3 have been plotted as a function of the carbon content of the compositions, because the carbon content must be between 0.25 and 0.35% by weight for reasons of hardness, but also because, outside that range, extremely undesirable carbide-based precipitates are formed.

An examination of FIG. 1, in which the curve labeled 1 represents the austenite phase and the curve labeled 7 represents the niobium carbonitride phase, reveals that the niobium carbonitride curve exceeds the austenite curve only for carbon levels that are greater than 0.5% by weight, which implies that the theoretical eutectic γ/Nb(C,N) (represented by the letter E) is located to the right of the diagram.

On the other hand, an examination of FIG. 2, on which the curves are labeled the same as in FIG. 1, shows that the eutectic is obtained for a carbon content of 0.30% by weight.

Figure 4:
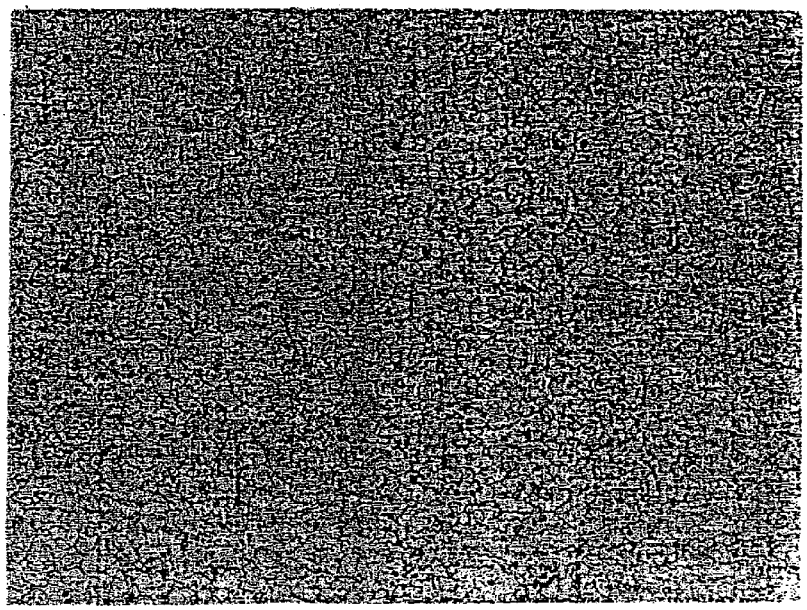
FIGS. 4, 6 and 7 represent structures of steels as taught by the invention at different stages of their preparation and use.
Figure 6:
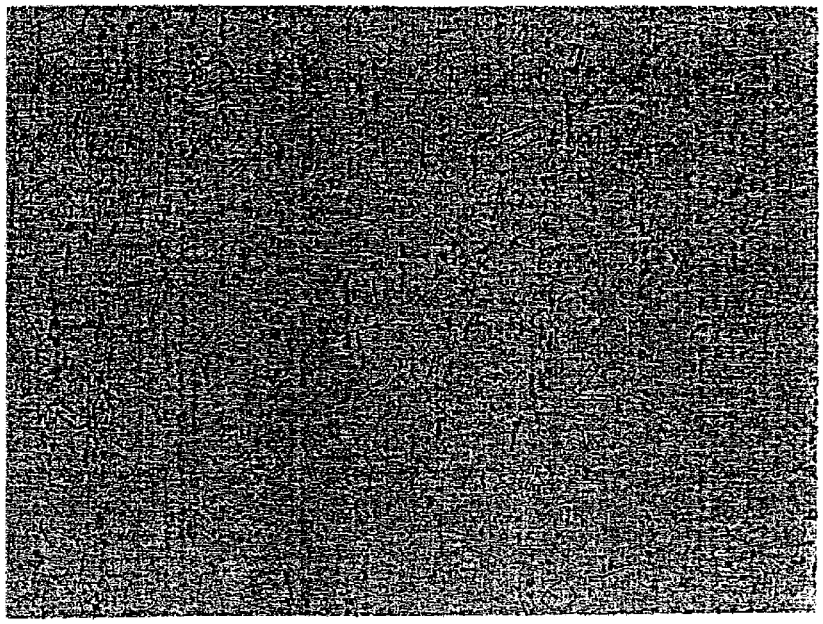

When molten steel that has the theoretical eutectic composition is cooled, the niobium carbonitrides that are formed when the temperature of said eutectic is reached precipitate very early and are then distributed uniformly in the rest of the molten steel that surrounds them. The structure that results from the conventional thermomechanical transformations, which generally include rolling followed by the cooling of the rolled parts, is uniform and altogether remarkable. This structure is illustrated in FIG. 4. This structure retains its good homogeneity throughout the cross section of the bars following heat treatments or reheats at very high temperatures (>1100° C.) as illustrated in FIG. 6.

Figure 5:
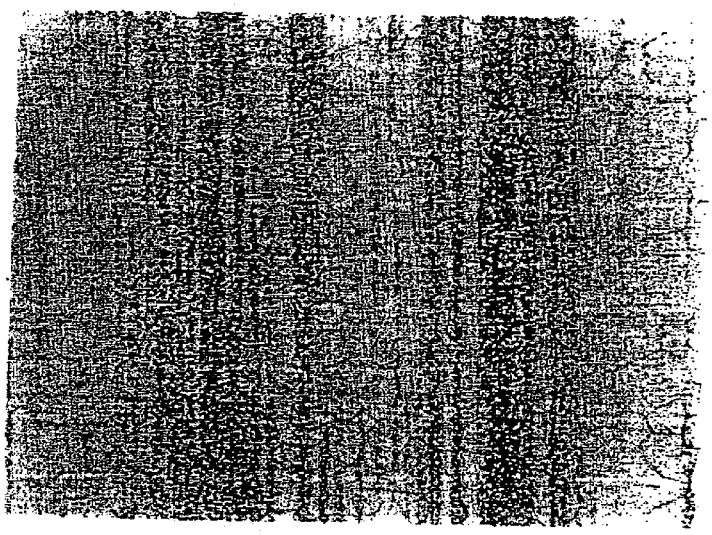
FIG. 5 shows the structure of steel of the prior art.

For purposes of comparison, FIG. 5 also shows the conventional banded structure obtained with the austenitic stainless steels of the prior art. These segregated bands are not uniform; the dark bands contain the carbides while the lighter bands do not. These bands are in fact obtained after drawing of the steel, which contains dendrites of the austenitic phase and an interdentritic and intergranular network of carbides that result from an end-of-solidification reaction.

These differences in structure result in major differences in behavior, specifically during the hot transformation of the steel heats that have just been prepared. If the structure of the steel composition is heterogeneous, as is the case of the compositions of the prior art, the final structure of the parts produced will itself be heterogeneous, resulting in variations of the properties of the steel.

Moreover, the heterogeneity of the structure can have other disadvantages during the fabrication of the parts. For example, during the fabrication of valves for vehicles powered by internal combustion engines, the automaker shears round steel bars that have a diameter of 6 to 13 mm on automated production lines. Because the structure of the steel is not homogeneous, the shearing will not be uniform, which results in the appearance of cracks and necessitates frequent adjustments of the production lines.

In one preferred embodiment of the invention, the levels of nitrogen, niobium and carbon in the steel, which are the three elements that form niobium carbonitride Nb(C,N) are selected so that the resulting steel compositions are hyper-eutectic in the theoretical phase diagrams. The phase diagrams in FIG. 3 represent one example of a composition of this type for which the eutectic E corresponds to a carbon level of approximately 0.15% by weight. The hyper-eutectic compositions taught by the invention, for which the carbon concentration is between 0.25 and 0.35%, preferably between 0.25 and 0.32% by weight, have the advantage that the precipitation of the niobium carbonitrides occurs very early during the solidification process, thereby allowing an optimal distribution of the precipitates within the melt.

It should also be noted that although the compositions can be qualified as hyper-eutectic in the theoretical phase diagrams, in industrial practice the inventors have also noted the primary precipitation of the austenite phase. This discrepancy between theory and the reality of experience can be explained by the phenomena of remelting, germination and phase growth.

An examination of these diagrams shows one of the advantages of the compositions taught by the invention, which is that the eutectic γ/Nb(C,N) is retained even with low levels of carbon, because nitrogen is substituted for the carbon in the Nb(C,N) compound. It is therefore possible to preserve the favorable effect of the eutectic on the solidification structures, while limiting the level of carbon in the steel, which has several interesting consequences, as will be explained below.

One of the favorable consequences of the limited levels of carbon is that there exists a very wide range of temperatures (approximately 1,175° C. to 1,300° C.) in which the structure consists exclusively of austenite and niobium carbonitrides. In particular, the undesirable carbide $M_{23}C_6$ is completely dissolved, which makes possible a good response of the metal during thermomechanical transformation operations such as rolling or extrusion/forging.

The presence of niobium carbonitride in this range of temperatures also has the advantage of limiting the enlargement of the grains during the recrystallization heat treatments, solution annealing and/or tempering of the finished products. The recrystallized structures are therefore homogeneous, which is a very valuable characteristic and one which is very difficult to achieve repeatably when steel compositions of the prior art are used.

The inventors have also sought to limit the level of carbon in the compositions taught by the invention to reduce the potential level of grain boundary precipitation of the undesirable carbide $M_{23}C_6$ during the final stabilization annealing of the pieces or during the utilization of the parts made from these steels. This potential level of precipitation nevertheless remains high in the compositions taught by the invention, because nitrogen is substituted for the carbon to form nitrides and carbonitrides. However, it has been found that, surprisingly, the ductility at room temperature, measured by elongation in the $A_{5d}$ tensile test, remains very good. The oxidation resistance characteristics are also excellent.

The inventors have also found that the structure obtained upon completion of the solidification of the ingots undergoes a major modification after the conventional thermomechanical transformation operations (rolling etc.).

It has been found that the network of small rods of eutectic carbonitrides Nb(C,N) disappears, leaving instead a relatively uniform distribution of globular carbonitrides Nb(C,N) in the transformed products, such as rolled bars, for example, as illustrated in FIG. 6.

Figure 7:
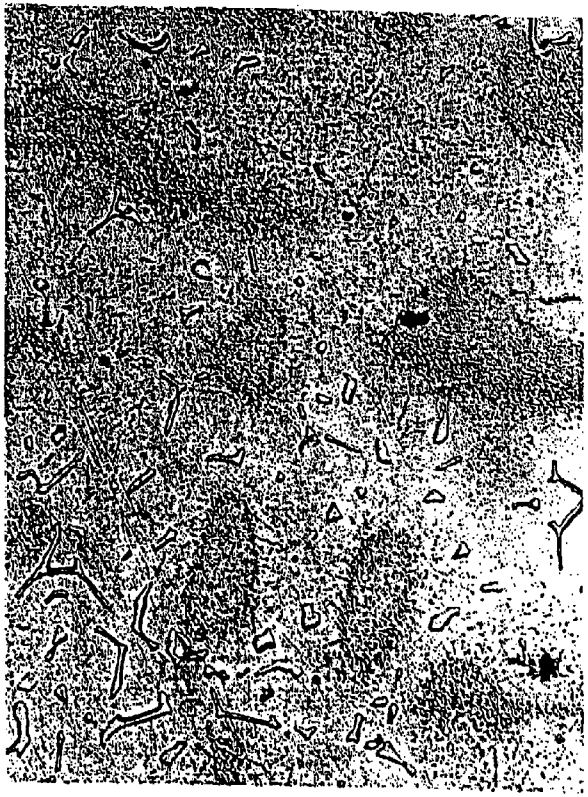

When the concentrations of nitrogen, niobium and carbon are such that the resulting compositions are hypo-eutectic in the theoretical phase diagrams, the niobium carbonitrides are precipitated only at the end of the solidification, resulting in a distribution which is a priori less advantageous. The result is what is called a "Chinese script" structure, as illustrated in FIG. 7. Nevertheless, here again, it has surprisingly been found that the network of small rods forms globules after forging, which makes possible a subsequent transformation without any particular problems. On the other hand, the band structure is even more apparent.

The excellent properties observed for the steel compositions taught by the invention are obtained thanks to the precise balancing of the alloy elements.

The chromium is used essentially to obtain good oxidation resistance thanks to the passivated oxide layer which it forms on the surface of the metal. It also has a beneficial influence on the high-temperature mechanical strength. The level of chromium in the compositions taught by the invention is from 24 to 28%, preferably 25 to 26% by weight.

Nickel has a desired gamma-forming effect. The quantity of nickel that can be used is limited on account of its price to a level that is just sufficient for the solidification of the matrix in the austenite mode. The level of nickel in the compositions taught by the invention is from 10 to 15%, preferably 11.5 to 12.5% by weight.

Carbon has the desired hardening effect, but an excessive amount results in the precipitation of carbides that increase brittleness and have an adverse effect on oxidation resistance. The level of carbon in the compositions taught by the invention is from 0.25 to 0.35% by weight, preferably 0.25 to 0.32%.

Nitrogen is a highly effective gamma-forming element which among other things makes it possible for the compositions taught by the invention to remain in the austenitic range while retarding the precipitation of the intermetallic phases. However, the level of nitrogen is limited on account of the problems encountered in introducing it into steel compositions on account of its low limit of solubility in molten steel. The level of nitrogen is 0.5 to 0.7%, preferably 0.61 to 0.7% by weight. These levels also correspond to quasi-saturation at equilibrium of the liquid metal at the conventional processing temperatures, which is an advantage, because this addition is then easy to do with conventional means that are known to technicians skilled in the art. In addition, because the solidification of the steel taught by the invention gives birth to two phases (austenite and niobium carbonitride) which can accept a lot of nitrogen, there is no untimely degasification reaction in the ingots which can generate undesirable bubbles or blisters.

Manganese facilitates the introduction of nitrogen into the composition by increasing the value of its limit of solubility in liquid and solid phases, but the quantity of manganese is limited on account of its undesirable effects on oxidation resistance. The level of manganese in the compositions taught by the invention is 3 to 6%, preferably 4.8 to 5.2% by weight.

Niobium, in addition to its carbide-forming properties which are favorable for the high-temperature strength of the steel, makes it possible to achieve the eutectic described above. The level of niobium in the compositions taught by the invention is 1.75 to 2.50%, preferably 1.90 to 2.30% by weight.

Silicon is limited to a maximum level of 0.30% by weight, although it improves the oxidation resistance, because it is strongly sigma-forming and also reduces the solubility of nitrogen.

The steel compositions taught by the invention can be used to manufacture parts according to processes applicable to the conventional materials cited as references, taking these special characteristics into account.

For example, the steels cannot be prepared in a vacuum, because the liquid must be saturated with nitrogen. For this purpose, an electric furnace or an AOD (Argon Oxygen Decarburization) furnace can be used, or any other suitable means for the preparation of steels that contain high levels of the alloy element nitrogen, including the secondary refining processes by electroslag remelting. The remelting can be done, for example, under slag using a consumable electrode if the objective is to achieve a low level of inclusions.

These operations may optionally be followed by a conventional hot thermomechanical transformation process such as forging or rolling, which can in turn be followed by a tempering treatment, which will preferably be performing by holding the steel at 1,050 to 1,100° C. for 1 to 16 hours in air or in another fluid which guarantees a complete fine-grain recrystallization and satisfactory ductility characteristics.

The solution annealing and recrystallization annealing treatments as well as the preheating of products for the manufacture of the valves can be performed between 1,100 and 1,200° C.; the highest temperatures result in limited grain growth.

The purpose of the stabilization annealing is to guarantee a certain structural and dimensional stability at the temperatures at which the steel will be used. This treatment can be carried out, for example, in the form of a hold at 700–1000° C. for 1 to 16 hours in air or in another fluid. Generally speaking, it is preferable to perform this treatment at a temperature that is higher than or equal to the temperature at which the part will be used.

Tests

The symbols used in the following description have the following meanings:

$R_m$=maximum strength $R_{p02}$=conventional limit of elasticity at 0.2% deformation $A_{sd}$=elongation in % on the basis of 5 d (d=diameter of the test piece).

All the percentages indicated are percentages by weight.

The various tests were performed on one hand on two compositions taught by the invention designated A and B, and on the other hand on a composition C which is not a composition that is claimed by this patent and was created specifically for purposes of comparison, as well as on three reference steel compositions designated D, E and F.

The three reference steels of the prior art are the following:

D: X50CrMnNiNbN 21.9 (DIN 1.4882)

E: X33CrNiMnN 23.8 (DIN 1.4866)

F: X35CrNiMnMoW 25.9

$R_m$, $R_{p02}$ and $A_{5d}$ are measured by means of a tensile test.

TABLE 1

| | A* | B* | C | D | E | F |
|---|---|---|---|---|---|---|
| C | 0.30% | 0.30% | 0.286% | 0.52% | 0.35% | 0.35% |
| Cr | 25.46% | 25.35% | 25.21% | 20.70% | 22.75% | 25.50% |
| Ni | 12.00% | 12.10% | 11.92% | 3.60% | 7.50% | 9.00% |
| Mn | 4.90% | 4.84% | 4.93% | 8.60% | 3.25% | 5.00% |
| Nb | 2.00% | 1.98% | 1.55% | 2.10% | — | 0.45% |

TABLE 1-continued

| | A* | B* | C | D | E | F |
|---|---|---|---|---|---|---|
| N | 0.644% | 0.55% | 0.50% | 0.47% | 0.275% | 0.515% |
| Si | 0.22% | 0.25% | 0.292% | 0.35% | 0.70% | 0.18% |
| W | — | — | — | 0.99% | — | 0.725% |
| Mo | — | — | — | — | — | 0.725% |
| V | — | — | — | — | — | 0.45% |
| Fe | rest | rest | rest | rest | rest | rest |
| C + N | 0.944 | 0.850 | 0.786 | 0.990 | 0.625 | 0.865 |

*prepared as taught by the invention

Mechanical Properties at Ambient Temperature and at Elevated Temperatures

Because the mechanical strength values of the valve steels are very strongly dependent on the conditions under which they have been annealed, the values that have been compared below are average values obtained for different thermal operating conditions, all including a high-temperature solution annealing followed by aging at a lower temperature.

In addition to the statistical fluctuations of the strength levels from one lot to another (on the order of several tens of MPa), it was found that the elevation of the aging temperature and/or an increase in the hold time at the aging temperature results in a drop in the strength levels, in particular in the limit of elasticity, a phenomenon that is linked to the coalescence of the carbides and other precipitates.

That implies that the mechanical strength values measured on a sample treated by short-term aging at a temperature that is lower than the service temperature are meaningless, because these values would decrease rapidly during the operational use of the parts manufactured from the steels in question.

A technician skilled in the art will therefore regard the data in the literature with some degree of skepticism, in particular when the annealing conditions of the tested pieces are not specified.

That is why the tested compositions were solution annealed at 1,160° C. for 1 hour and then cooled in water, then aged for 4 hours at 850° C., with the exception of Grade F, which was solution annealed at 1,120° C. for 1 hour, then cooled in water, and then aged at 820° C. for 4 hours.

The aging at 850° C. corresponds to a temperature that is deemed to be equal to or higher than the temperature at which the valves will be operated in modern engines where the prevailing temperatures are very high.

TABLE 2

| Materials | Test temperature (° C.) | $R_m$ (MPa) | $R_{p0.2}$ (MPa) | $A_{5d}$ (%) |
|---|---|---|---|---|
| A* | ambient | 1001 | 605 | 26 |
| | 800° C. | 419 | 263 | 27 |
| | 850° C. | 348 | 226 | 29 |
| B* | ambient | 964 | 563 | 26.5 |
| | 800° C. | 394 | 249 | 35.5 |
| | 850° C. | 342 | 226 | 40 |
| C | ambient | 957 | 558 | 28.5 |
| | 800° C. | 375 | 234 | 36 |
| | 850° C. | 298 | 203 | 30 |
| D | ambient | 968 | 555 | 23.8 |
| | 800° C. | 350 | 209 | 41 |
| | 850° C. | 281 | 187 | 41 |
| E | ambient | 916 | 491 | 32 |
| | 800° C. | 352 | 209 | 51.5 |
| | 850° C. | 286 | 175 | 68.5 |

TABLE 2-continued

| Materials | Test temperature (° C.) | $R_m$ (MPa) | $R_{p0.2}$ (MPa) | $A_{5d}$ (%) |
|---|---|---|---|---|
| F | ambient | 1033 | 606 | 24 |
| | 800° C. | 373 | 244 | 34 |
| | 850° C. | 307 | 191 | 49 |

*prepared as taught by the invention

It has therefore been determined that for aging treatments suitable for use at very high temperatures, the alloys taught by the invention exhibit mechanical strength levels that are higher than those of the reference steels, and even more so when the nitrogen level is between 0.64% and 0.70% by weight, at least.

Creep-elongation Strength

This strength is determined on the basis of the value of the stress that results in 1% elongation by creep in 100 hours.

The three grades A, B and C were previously treated by solution annealing and aging at 850° C. for 4 hours, while the reference steel grades were treated in the manner conventional for each steel, which is to their advantage in the comparison.

The results are presented in Table 3.

TABLE 3

| Materials | Test temperature (° C.) | Stress for 1% elongation (MPa) |
|---|---|---|
| A | 815 | 76 |
| B | 815 | 62 |
| C | 815 | 59 |
| D | 815 | 27 |
| E | 815 | 82* |
| F | 815 | 60 |

Tests of Resistance to Corrosion and Oxidation

1. Resistance to corrosion by sodium sulfate+NaCl

This test is used to reproduce the conditions experienced by the valves when they are in contact with the combustion fumes of Diesel engines in a marine environment, where the corrosion is aggravated by the presence of chlorides.

The steel test piece is a cylinder 12 mm in diameter and 12 mm long cut in the axis of the products. The test piece is weighed and then placed in a cold alumina crucible which is filled with a mixture of 90% by weight of sodium sulfate and 10% by weight of sodium chloride which has previously been melted for 20 minutes in an electric furnace at a temperature of approximately 927° C. The whole test apparatus is left in the furnace, at that temperature, for one hour.

The test piece is then removed from the crucible and allowed to cool in air. It is then pickled by immersion for approximately 15 minutes in an aqueous solution that has previously been heated to 100° C. and containing 12% ferric sulfate and 2.5% of a 40% HF solution. The weight loss is then measured.

The pickling/weighing cycle is repeated several times, and then the weight of the test piece is plotted on a graph as a function of the cumulative duration of the picklings. This graph should show a first straight line which represents the attack of the oxide formed in contact with the corrosive mixture, then a second straight line which represents the attack of the uncorroded steel by the pickling solution. The intersection of these two straight lines makes it possible to obtain the weight loss of the test piece Am due to corrosion by molten lead oxide. The corrosion rate C is then calculated on the basis of the formula presented below:

$$C = \frac{\Delta m}{S \cdot t}$$

Δm: Loss of weight of the test piece in g

S: Initial surface area of the test piece in $dm^2$ t: Duration of the corrosion test in hours.

2. Resistance to Oxidation in Air

The steel test piece is a cylinder 6 mm in diameter and 20 mm long cut along the axis of the products, and with a hole 3 to 4 inches in diameter.

This tests consists of bringing the test piece, which was previously placed in an alumina crucible, to a temperature of 871° C. for 100 hours in an electric furnace, and then allowing the test piece to cool. This test piece is weighed before and after the oxidation, and the weight gain is determined according to the formula presented below:

$$\text{Weight gain} = \frac{Pf - Pi}{S}$$

Pf: Weight after oxidation

Pi: Initial weight

S: Initial surface area of the test piece in $dm^2$

Several successive picklings are then performed as for Test 1. The first picklings last 10 minutes, and the duration of the pickling is gradually increased to 20, 40 and then 60 minutes. The pickling is stopped when the uncorroded metal is attached.

The graph of the weight of the test piece as a function of the cumulative duration of the picklings once again gives two straight lines with different slopes, the intersection of which gives the value of the weight Pr of the uncorroded metal. The weight loss is then calculated as follows:

$$\text{Weight loss} = \frac{Pi - Pr}{S}$$

The results of the corrosion and oxidation tests are presented together in the following table:

TABLE 4

| | Corrosion in the | Oxidation in air | |
|---|---|---|---|
| Materials | molten salts C ($g/dm^2/h$) | Change in weight at the end of the test ($g/dm^2/100$ h) | Oxide weight - Loss after pickling ($g/dm^2/100$ h) |
| A [1)] | 0.3 | 0.120–0.1180 | 0.80–1.10 |
| B [1)] | 12.5 | −0.020 | 0.36–0.52 |
| C [1)] | 19.2 | 0.020 | 0.71–0.78 |
| D [2)] | — | −0.091 | 1.45–2.50 |
| E [2)] | 0.2 | 0.047 | 0.45–0.75 |
| F [2)] | 63–70 | — | 0.45–0.60 |

[1)] Metal treated by solution annealing and aging for 4 hours at 850° C.
[2)] Conventional treatment, depending on the steel Although the thermal treatments of these steels are not absolutely identical, it has been found that the oxidation rates of the steels taught by the invention (A and B) are less than those of the reference steel D, and are on the same order as those of the better steels of the prior art, or even better in the case of Grade B.

An increase in the content of niobium, all other things being equal (C/B), improves the oxidation resistance, because it seems that the nitrogen preferentially forms the nitride NbN rather than the nitride $Cr_2N$, thereby leaving more chromium free and not fixed.

It is therefore apparent that the steel as taught by the invention can produce a very good resistance to oxidation in spite of concentrations of C+N as high as 1%.

The inventors were very surprised to find a very marked improvement in corrosion resistance in the medium $Na_2SO_4$+NaCl with an increase in the nitrogen content of the steel taught by the invention. When the nitrogen content is in the highest range, this corrosion resistance in molten salts is equivalent to that of the best reference steel, in spite of a grain boundary precipitation rate of nitrides and carbides which is much higher.

It has therefore been found that the steels taught by the invention exhibit both excellent mechanical properties at ambient temperature and at very high temperatures, as well as excellent resistance to oxidation and corrosion by molten salts.

It goes without saying that the embodiments of the invention that have been described above have been presented purely as examples and are in no way intended to be restrictive, and that numerous modifications can easily be made by a technician skilled in the art without thereby going beyond the context of the invention.

For example, although the principal application of the compositions taught by the invention described here is the manufacture of valves for vehicles powered by an internal combustion engine, it is clear that the invention is not limited to such an application, and that it can be used to manufacture all parts that are required to withstand similar or identical stresses, as might be the case for hot working tools, for example, fasteners (screws, nuts) or control mechanisms.

What is claimed is:

1. A steel composition comprising, expressed in percentages by weight:

| | |
|---|---|
| C | 0.25–0.35% |
| Cr | 24–28% |
| Ni | 10–15% |
| Mn | 3–6% |
| Nb | 1.75–2.50% |
| N | 0.50–0.70% |
| Si | 0–0.30% |

whereby C+N≧0.8%, and the rest consists primarily of iron and the unavoidable impurities.

2. The steel composition as claimed in claim 1, wherein the steel composition contains 25 to 26% by weight of chromium.

3. The steel composition as claimed in claim 1, wherein the steel composition contains 1.90 to 2.30% by weight of niobium.

4. The steel composition as claimed in claim 1, wherein the steel composition contains 0.61 to 0.70% by weight of nitrogen.

5. The steel composition as claimed in claim 1, whereby C+N≧0.9%.

6. The steel composition as claimed in claim 1, wherein the steel composition contains, expressed in percentages by weight:

| | |
|---|---|
| C | 0.25–0.32% |
| Cr | 25–26% |
| Ni | 11.50–12.50% |
| Mn | 4.80–5.20% |
| Nb | 1.90–2.30% |
| N | 0.61–0.70% |
| Si | 0–0.30% |

whereby C+N≧0.9%, and the rest consists primarily of iron and the unavoidable impurities.

7. The steel composition as claimed in claim 1, wherein the levels of carbon, nitrogen and niobium are also selected so that said steel composition is hypereutectic in the theoretical phase diagrams (FIGS. 2 and 3).

8. A method for the preparation of a steel having a composition of:

| | |
|---|---|
| C | 0.25–0.35% |
| Cr | 24–28% |
| Ni | 10–15% |
| Mn | 3–6% |
| Nb | 1.75–2.50% |
| N | 0.50–0.70% |
| Si | 0–0.30%, |

comprising the steps of:

preparing a consumable electrode of the said composition; and electroslag remelting the consumable electrode.

9. The method as claimed in claim 8, further including the steps of:

solution annealing the steel at 1100–1200° C.; and heat treating at a temperature greater than or equal to the temperature at which said steel will be used.

10. A part, comprising:

a valve having a steel composition of:

| | |
|---|---|
| C | 0.25–0.35% |
| Cr | 24–28% |
| Ni | 10–15% |
| Mn | 3–6% |

-continued

| | |
|---|---|
| Nb | 1.75–2.50% |
| N | 0.50–0.70% |
| Si | 0–0.30%, |

wherein the steel composition is prepared by:

melting a consumable electrode of the said steel composition; and electroslag remelting the consumable electrode.

11. The method as claimed in claim 8, further including the step of forming the steel by a hot thermomechanical process by one of forging or rolling.

12. The method as claimed in claim 11, further including the step of thermal tempering the steel between 1050 and 1100° C., after the step of forming the steel.

13. The method as claimed in claim 11, further including the steps of:

solution annealing the steel at 1100–1200° C.; and heat treating at a temperature greater than or equal to the temperature at which said piece will be used.

14. The method as claimed in claim 12, further including the steps of:

solution annealing the steel at 1100–1200° C.; and heat treating at a temperature greater than or equal to the temperature at which the steel will be used.

15. The part as claimed in claim 10, wherein the steel composition is further prepared by:

forming the steel by a hot thermomechanical process by one of forging or rolling.

16. The part as claimed in claim 15, wherein the steel composition is further prepared by thermal tempering the steel between 1050–1100° C.

17. The part as claimed in claim 15, wherein the steel composition is further prepared by solution annealing the steel at 1100–1200° C. and heat treating at a temperature greater than or equal to the temperature at which the steel will be used.

18. The part as claimed in claim 16, wherein the steel composition is further prepared by solution annealing the steel at 1100–1200° C. and heat treating at a temperature greater than or equal to the temperature at which the steel will be used.

* * * * *

UNITED STATES PATENT AND TRADEMARK OFFICE

CERTIFICATE OF CORRECTION

PATENT NO. : 6,656,418 B2
DATED : December 2, 2003
INVENTOR(S) : Jacques Montagnon et al.

It is certified that error appears in the above-identified patent and that said Letters Patent is hereby corrected as shown below:

Title page,
Item [30], Foreign Application Priority Data, insert:
-- May 10, 2000 FR 0005967 --.

Signed and Sealed this

Twentieth Day of April, 2004

JON W. DUDAS
*Acting Director of the United States Patent and Trademark Office*